US005735600A

United States Patent [19]

Wyness et al.

[11] Patent Number: 5,735,600

[45] Date of Patent: Apr. 7, 1998

[54] METHOD AND APPARATUS FOR AUTOMATICALLY MIXING DRINKING WATER IN A RESERVOIR

[75] Inventors: David K. Wyness, Springfield; Donald N. Ruehrwein, Batavia; John S. Andrepont, Naperville, all of Ill.

[73] Assignee: Chicago Bridge & Iron Technical Services Company, Oak Brook, Ill.

[21] Appl. No.: 659,136

[22] Filed: Jun. 4, 1996

[51] Int. Cl.[6] ..... B01F 13/02; B01F 5/10

[52] U.S. Cl. ..... 366/101; 366/137; 366/173.1; 366/174.1

[58] Field of Search ..... 366/101, 106, 366/136, 137, 159.1, 163.1, 163.2, 167.1, 173.1, 173.2, 174.1, 175.2, 177.1, 179.1, 341, 347, 348, 349; 222/195

[56] References Cited

U.S. PATENT DOCUMENTS

| | | | |
|---|---|---|---|
| 579,039 | 3/1897 | Brashear . | |
| 783,148 | 2/1905 | Snow . | |
| 827,620 | 7/1906 | Crane | 366/136 X |
| 923,571 | 6/1909 | Paterson | 366/167.1 X |
| 1,000,689 | 8/1911 | Paterson | 366/136 X |
| 1,026,578 | 5/1912 | Hammond | 366/137 |
| 1,054,629 | 2/1913 | Warwick | 366/136 X |
| 1,997,808 | 4/1935 | Blackburn . | |
| 2,741,268 | 4/1956 | Plunkett . | |
| 3,219,224 | 11/1965 | Anderson . | |
| 4,261,837 | 4/1981 | West, Jr. et al. . | |
| 4,337,152 | 6/1982 | Lynch . | |
| 4,900,434 | 2/1990 | Schade . | |
| 5,160,611 | 11/1992 | Krofta . | |
| 5,462,654 | 10/1995 | Hering, Jr. . | |

FOREIGN PATENT DOCUMENTS

| | | | |
|---|---|---|---|
| 61-47571 | 10/1986 | Japan | 366/101 |

*Primary Examiner*—Charles E. Cooley
*Attorney, Agent, or Firm*—Marshall, O'Toole, Gerstein, Murray & Borun

[57] ABSTRACT

In a drinking water reservoir, a draft tube is positioned above an inlet pipe to carry fresh water and water stored in a lower reservoir portion to an upper reservoir portion where the drinking water is mixed and stagnation of the reservoir contents is reduced. The draft tube can be used with a recycling pump and/or a mechanism for providing compressed gas to create a gas lifter to mix water in the lower storage portion with water in the upper storage portion when fresh water is not being added.

16 Claims, 1 Drawing Sheet

METHOD AND APPARATUS FOR AUTOMATICALLY MIXING DRINKING WATER IN A RESERVOIR

FIELD OF THE INVENTION

This invention relates generally to drinking water reservoirs and more particularly to a method and apparatus for automatically mixing the contents of the reservoir whenever fresh water is added.

BACKGROUND OF THE INVENTION

Drinking water distribution reservoirs, such as standpipes, ground storage tanks or elevated tanks, equalize supply and demand over periods of high water consumption and they supply water in the case of a failure in the water supply, treatment plant, or distribution system. When fresh water is added to the reservoir, the water typically is pumped into the lower portion of the reservoir. When there is a demand for drinking water, it is removed from near the bottom of the reservoir so that the last water added to the tank is typically among the first to be removed.

The water near the top of the reservoir is among the last to be removed so during periods of low demand, or where standby volumes in reservoirs are rarely used, a significant volume of water may be retained in the reservoir for long periods of time. During those times, the disinfectant residual in the water may dissipate and the water will become stagnant. Later, when the stagnant water from the near the top of the reservoir is used, the water may not meet regulatory requirements for minimum disinfectant concentrations and it may contain pathogenic, taste, and odor forming organisms. Typically, mixing systems are not used in water storage reservoirs because they are expensive to build, maintain, and operate.

It is desirable, therefore, to provide an inexpensive and easily maintained drinking water circulation system that reduces stagnation of the reservoir water, the dissipation of disinfectant, the growth of pathogens, and the growth of taste and odor producing organisms that accompany stagnation.

SUMMARY OF THE INVENTION

The present invention provides an economical way in which to reduce drinking water stagnation and the accompanying adverse consequences that occur in stagnant drinking water reservoirs. One method for mixing drinking water stored in a reservoir having an inlet pipe in the lower storage zone of the reservoir comprises the steps of: pumping fresh water through the inlet pipe in the reservoir; directing the fresh water from the inlet pipe into a draft tube to draw reservoir water into a draft tube inlet from the lower storage zone of the reservoir and out of a draft tube outlet into an upper storage zone. The method further reduces costs of a reservoir when the draft tube is used to at least partially support a reservoir roof or is positioned adjacent a wall of the reservoir so that the wall at least partially defines and supports the draft tube.

The method can be enhanced for periods when fresh water is not being pumped into the reservoir by using a recycling pump that pumps reservoir water from the lower storage zone, through the inlet pipe, and into the draft tube to draw additional quantities of water from the lower storage zone into the upper storage zone for mixture with the drinking water therein. Similarly, the draft tube can be used as a gas lifter by directing pressurized gas toward the draft tube inlet when fresh water is not being pumped in.

Apparatus for reducing stagnation of drinking water stored in a reservoir comprises: a fresh water pump; a reservoir inlet pipe for receiving fresh water from the pump and directing the fresh water upward into a lower storage zone in the reservoir; a draft tube disposed in the reservoir and having an inlet spaced apart from the inlet pipe to receive fresh water from the inlet pipe and drinking water from the lower storage zone, and having an outlet for emitting a mixture of fresh water and stored water into an upper storage zone of the reservoir.

The draft tube may be centrally disposed within the reservoir or it may be positioned near a wall of the reservoir. The draft tube may include means for at least partially supporting a roof over the reservoir and the draft tube may be at least partially defined by the reservoir wall to save cost.

The apparatus may include a recycling pump that pumps water from the lower storage zone, through the reservoir inlet pipe, and into the draft tube inlet to draw additional water from the lower storage zone into the draft tube and out into the upper storage zone.

The draft tube can be used as a gas lifting device, as well. When the main pump is not feeding fresh water into the reservoir inlet, compressed gas can be directed toward the draft tube inlet to draw water from the lower storage zone, through the draft tube, and into the upper storage zone.

DETAILED DESCRIPTION OF THE DRAWINGS

Figure 1:
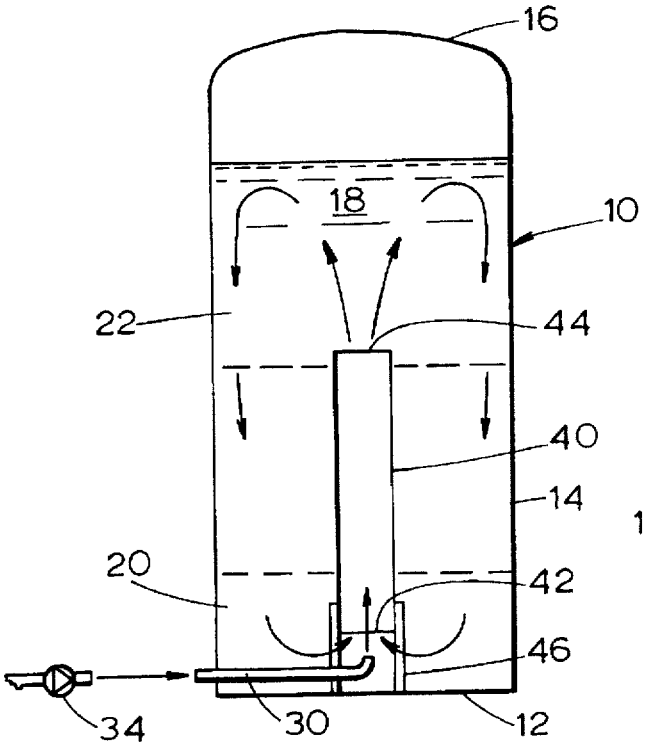
FIG. 1 is an elevation view of a reservoir mixing system in accordance with the present invention.

To the extent practical, the same reference numerals will be used for the same element in each of the figures. Referring to FIG. 1, there is depicted a drinking water storage reservoir 10 in the form of a standpipe. Other drinking water storage reservoirs, such as elevated tanks and ground storage tanks can include or be used in conjunction with the present invention. The reservoir includes an invert 12 in the bottom, a wall 14 surrounding the reservoir 10, and a roof 16.

Inside the reservoir 10 there is stored a quantity of drinking water 18. The water 18 is stored in a lower storage zone 20 and an upper storage zone 22 that are distinguishable by the water quality in the respective zones. The water in the lower storage zone 20 is of a better quality because it contains a higher residual amount of disinfectant than the water in the upper storage zone 22. This is possible because the fresh drinking water that is added to the reservoir 10 enters the bottom of the reservoir 10 through an inlet pipe 30. In prior drinking water storage reservoirs there is no means for circulating the fresh water and the disinfectant carried therein to the upper storage zone of the reservoir where mixing will reduce stagnation and the problems associated therewith. Stagnation is aggravated because the water in the lower storage zone 20 is the water that is the first to be withdrawn when there is a need. This first-in-first-out approach to water storage results in the rarely used water in the upper storage zone 22 being much more likely to stagnate and fail drinking water quality standards.

This is so even though the incoming fresh water is pumped in using a pump 34 which creates some turbulence in the lower storage zone 20. The turbulence is not enough to mix the contents of the lower storage zone 20 with the water in the upper contact zone 22.

Thus, in accordance with the present invention, a draft tube 40 is disposed in the reservoir 10 and supported above the invert 12 by support legs 46. The draft tube 40 includes an inlet 42 in the lower storage zone 20 and an outlet 44 in the upper storage zone 22. The draft tube inlet 42 is positioned above the reservoir inlet pipe 30 to receive the pressurized in flow of fresh water. As illustrated, the inlet pipe 30 is of a smaller diameter than the draft tube 40 and the inlet pipe 30 is spaced apart from the draft tube inlet 42. In this manner, drinking water stored in the lower storage zone 20 will be drawn into the draft tube 40 where it will mix with the fresh water and be emitted out of the draft tube outlet 32 and into the upper storage zone 22 where it then will mix with the water stored in the upper storage zone 22. Further, the flow of fresh water and water from the lower storage zone 20 into the upper storage zone develops a flow pattern through an annular space defined by the draft tube 40 and the wall 14 of the reservoir 10, as depicted by the arrows in FIG. 1. Although depicted in the center of the reservoir 10, the draft tube 40 can be positioned to one side or the other. Thus, using the draft tube 40 in a drinking water reservoir 10 with the existing inlet pipe 30 and pump 36, results in an automatic, inexpensive, and easily maintained mixing system that reduces stagnation in the reservoir's upper storage zone 22 and the dissipation of disinfectant that can eliminate pathogens and taste and odor producing organisms whenever fresh water is added to the reservoir 10.

Figure 2:
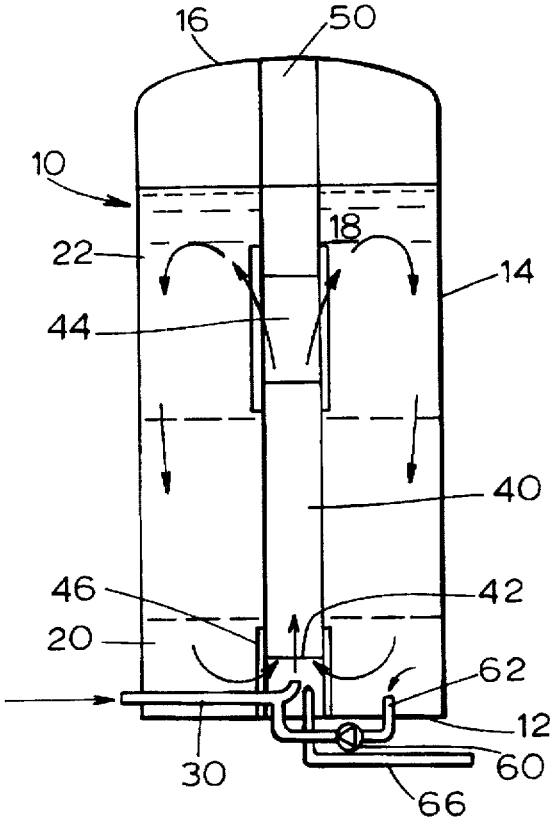
FIG. 2 is an alternate embodiment of a reservoir mixing system in accordance with the present invention.

FIG. 2 depicts an alternate embodiment of the present invention, which includes the reservoir 10, an inlet pipe 30, a pump 34, and a draft tube 40. In this embodiment, the draft tube outlet 44 is defined by openings in the wall of the draft tube 40 or in a gap in the draft tube 40. Above the outlet 44, the draft tube 40 extends upwardly at 50 toward the roof 16 of the reservoir 10 to at least partially support the roof 16. The dual purpose of this draft tube 40 design reduces structural costs associated with the roof 16.

Also illustrated in FIG. 2 is a recycling pump 60 that withdraws drinking water from the lower storage zone 20 and pumps it through the inlet pipe 30 and into the draft tube 40 in the same way that the fresh water is fed into the reservoir 10. With this arrangement the recycling pump 60 can be used when no fresh water is being pumped into the reservoir 10 to mix water from the lower storage zone 20 with water in the upper storage zone 22 to alleviate the problems discussed above resulting from stagnation.

Similarly, a gas nozzle 66 can be used as a gas lifter to direct a stream of compressed gas, such as air, into the draft tube 40 to draw drinking water from the lower storage zone 20 into and out of the draft tube to mix with the drinking water in the upper storage zone 22. A compressor (not illustrated) for the compressed gas can be positioned in any suitable location and communicate with the gas nozzle 66 via suitable conduits. Both the recycling pump 60 and the gas lifter 66 can be used in the embodiment illustrated in FIG. 1.

Figure 3:
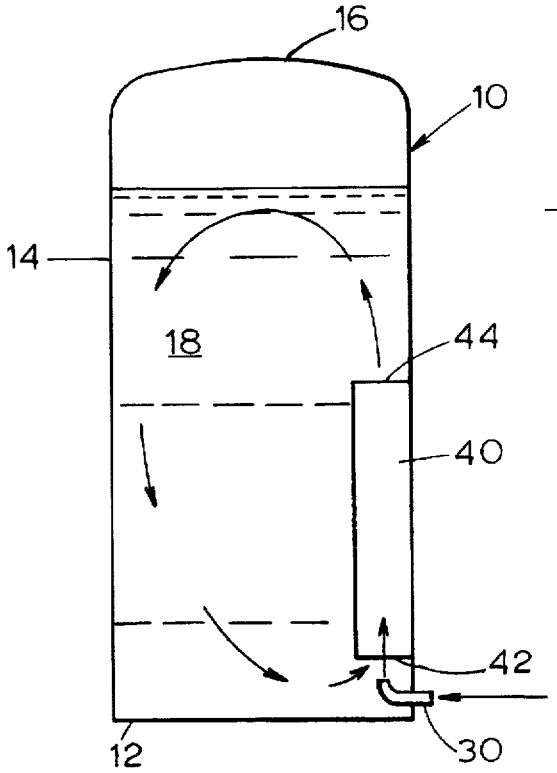
FIG. 3 is a second alternate embodiment in accordance with the present invention.

FIG. 3 illustrates yet another embodiment of apparatus for performing the present invention. The reservoir 10 in this illustration is similar to the others except that the inlet pipe 30 is positioned to the right side of the reservoir 10 and the draft tube 40 is defined by a substantially U-shaped plate (when viewed in cross-section) and the reservoir wall 14 to reduce construction and maintenance costs because there is less material used for the draft tube 40 and no additional supporting structure required for the draft tube 40. In most other respects this embodiment performs like those described above including the options of using recycling pumps 60 and gas lifters 66 to mix water from the lower storage zone 20 with water in the upper storage zone 22.

Multiple inlets and draft tubes can be used to obtain more thorough mixing, however as more draft tubes are added, the expense of building and maintaining the reservoir rises.

The forgoing detailed description is presented for clearness of understanding the invention and no unnecessary limitations therefrom should be read into the following claims.

We claim:

1. A method for mixing the contents of a drinking water storage reservoir comprising the steps of:

pumping fresh drinking water through a reservoir inlet pipe into a lower storage zone in the reservoir; and directing the fresh water into an inlet of a draft tube disposed in the reservoir to draw drinking water from the lower storage zone into the draft tube and out of an outlet in the draft tube in an upper storage zone of the reservoir.

2. The method for mixing the contents of a drinking water storage reservoir of claim 1 and further comprising the step of:

at least partially supporting a roof for the reservoir with the draft tube.

3. The method for mixing the contents of a drinking water reservoir of claim 1 and further comprising the steps of:

stopping the pumping of fresh water through the inlet pipe and into the draft tube; and feeding compressed gas into the draft tube to produce a gas lift of water from the lower storage zone, through the draft tube, and into the upper storage zone of the reservoir.

4. The method for mixing the contents of a drinking water reservoir of claim 1 and further comprising the steps of:

stopping the pumping of fresh water through the inlet pipe and into the draft tube; and recycling water from the lower storage zone in the reservoir, through the draft tube, and into the upper storage zone of the reservoir.

5. A method for reducing disinfectant depletion and growth of pathogens in drinking water stored in a reservoir comprising the steps of:

pumping fresh water through an inlet pipe in a lower storage zone in the drinking water reservoir;

directing the fresh water into an inlet end of a draft tube disposed in the reservoir to draw water from the lower storage zone into the draft tube inlet and out of a draft tube outlet to mix with drinking water in an upper storage zone;

stopping the pumping of fresh water through the inlet pipe; and feeding compressed gas into the draft tube inlet to draw drinking water from the lower storage zone into the draft tube inlet and out of the draft tube outlet to mix with drinking water in the upper storage zone.

6. The method of claim 5 and further comprising the step of:

at least partially supporting a roof for the reservoir with the draft tube.

7. The method of claim 5 and further comprising the steps of:

stopping the feed of compressed gas into the inlet end of the draft tube; and recycling drinking water from the lower storage zone in the reservoir through a pump and into the inlet end of the draft tube to draw more drinking water from the lower storage zone in the reservoir into the draft tube inlet and out of the draft tube outlet to mix with drinking water in the upper storage zone of the reservoir.

8. A method for reducing disinfectant depletion and growth of pathogens in a drinking water storage system, comprising the steps of:

pumping fresh water through an inlet pipe in a lower storage zone of the drinking water reservoir;

directing the fresh water from the inlet pipe to an inlet end of a draft tube to draw drinking water from the lower storage zone into the draft tube inlet and out of an outlet in the draft tube to mix with drinking water in the upper storage zone;

stopping the pumping of fresh water through the inlet pipe; and recycling water from the lower storage zone into the inlet pipe and the draft tube, to draw more water from the lower storage zone into and out of the draft tube for mixing with water in the upper storage zone.

9. The method of claim 8 and further comprising:

at least partially supporting a roof on the reservoir with the draft tube.

10. The method of claim 8 and further comprising the steps of:

stopping the pumping of fresh water and recycled water through the reservoir inlet and into the draft tube inlet; and feeding pressurized gas into the draft tube inlet to draw drinking water from the lower storage zone into the draft tube inlet.

11. Apparatus for circulating drinking water in a reservoir to reduce disinfectant depletion and growth of pathogens in the drinking water stored in the reservoir, comprising:

a reservoir inlet pipe in liquid communication with a lower storage zone of the reservoir;

a pump for pumping water through the inlet pipe; and a draft tube having an inlet positioned above the inlet pipe for receiving fresh water from the inlet pipe, and an outlet positioned in an upper storage zone in the drinking water reservoir for emitting a mixture of fresh water and water from the lower storage zone into the upper storage zone.

12. The apparatus of claim 11 in which the draft tube has means for at least partially supporting a roof on the reservoir.

13. The apparatus of claim 11 in which the draft tube is defined in part by a wall of the reservoir.

14. The apparatus of claim 11 and further comprising:

means for injecting compressed gas into the draft tube inlet to draw drinking water stored in the lower storage zone of the reservoir into the draft tube.

15. The apparatus of claim 11 and further comprising:

a conduit having an inlet in liquid communication with the lower storage zone of the reservoir and an outlet disposed below the draft tube inlet; and a recycling pump for drawing reservoir water into the conduit inlet, out of the conduit outlet, and into the draft tube inlet to draw drinking water from the lower storage zone into the draft tube for circulation in the reservoir.

16. The apparatus of claim 11 and further comprising:

conduit means having an inlet for receiving drinking water from the reservoir, and an outlet for feeding drinking water to the reservoir inlet pipe; and recycling pump means for pumping drinking water through the conduit means and through the inlet pipe for discharge into the draft tube.

* * * * *